US009644437B1

(12) United States Patent
Hulin

(10) Patent No.: US 9,644,437 B1
(45) Date of Patent: May 9, 2017

(54) SPLASH GUARD

(71) Applicant: Roderick J. Hulin, Crowley, LA (US)

(72) Inventor: Roderick J. Hulin, Crowley, LA (US)

(73) Assignee: Roderick J. Hulin, Crowley, LA (US)

( * ) Notice: Subject to any disclaimer, the term of this patent is extended or adjusted under 35 U.S.C. 154(b) by 0 days.

(21) Appl. No.: 14/626,785

(22) Filed: Feb. 19, 2015

Related U.S. Application Data

(60) Provisional application No. 61/941,822, filed on Feb. 19, 2014.

(51) Int. Cl.
*B65D 25/00* (2006.01)
*E21B 21/06* (2006.01)

(52) U.S. Cl.
CPC ..... *E21B 21/065* (2013.01)

(58) Field of Classification Search
CPC .... A47L 11/4077; B61D 45/006; B61D 47/00
USPC ..... 220/9.1, 9.4, 23.9, 23.91, 731
See application file for complete search history.

(56) References Cited

U.S. PATENT DOCUMENTS

| | | | | |
|---|---|---|---|---|
| 3,304,093 | A * | 2/1967 | Van Der Lely | A01C 17/00 192/105 BA |
| 3,365,103 | A * | 1/1968 | Van Der Lely | A01C 17/00 222/572 |
| 4,423,568 | A | 1/1984 | Gould | |
| 5,372,174 | A | 12/1994 | Wilke | |
| 5,971,679 | A | 10/1999 | Kim | |
| 6,176,656 | B1 | 1/2001 | Seong | |
| 6,253,395 | B1 | 7/2001 | Quam | |
| 7,753,126 | B2 * | 7/2010 | Reddoch, Sr. | E21B 21/066 166/357 |
| 7,959,386 | B2 * | 6/2011 | Hara | B23Q 11/0891 409/134 |
| 8,141,197 | B2 | 3/2012 | Allard | |
| 8,214,939 | B2 | 7/2012 | Spurlock | |
| 9,181,026 | B2 * | 11/2015 | Laing | E04H 4/0056 |
| 2013/0017018 | A1 * | 1/2013 | Allen | E02D 27/01 405/114 |

* cited by examiner

*Primary Examiner* — Shawn M Braden

(57) ABSTRACT

A splash guard designed to prevent drilling fluid from splashing onto walkways and working surfaces around a shale shaker. The splash guard is equipped with frame assemblies and vertical panels that are positioned so that any fluid splashing out of the shale shaker strikes the panels and then drains back into the shale shaker.

3 Claims, 9 Drawing Sheets

SPLASH GUARD

CROSS REFERENCE TO RELATED APPLICATIONS

The present application claims priority from provisional patent application No. 61/941,822, filed on Feb. 19, 2014.

FIELD OF THE INVENTION

The subject invention relates to splash guards for shale shakers.

BACKGROUND

Shale shakers are components of drilling equipment used in many industries, such as the oil and gas industry. Shale shakers are typically used to remove large solids from a fluid. For example, during oil and gas drilling operations, drilling fluid is pumped from a pit into the well through the drill string. As the drilling fluid is pumped down the drill string, it is eventually sprayed through nozzles in the drill bit. The drilling fluid cleans and cools the drill bit and then carries the crushed or cut rock ("cuttings") up the annular space existing between the drill string and the walls of the hole that is being drilled. Once the drilling fluid reaches the surface of the well, it is fed into a shale shaker to remove the cuttings from the drilling fluid.

Shale shakers typically consist of several parts, including a hopper, a feeder, a screen basket, and a vibrator. The hopper serves as a platform for the shale shaker. The feeder is essentially a collection pan for the drilling fluid before it is fed to the screen basket. The screen basket separates the cuttings from the drilling fluid. The vibrator is typically a specialized motor built for the purpose of vibrating the screen basket. As the screen basket vibrates, the drilling fluid containing the cuttings travels along the screen basket. The drilling fluid seeps through the screen basket, while the cuttings continue to vibrate along the screen basket until they reach a point of discharge.

The vibrating action of the screen basket causes the drilling fluid to splash. Some of the drilling fluid is splashed out of the shale shaker onto surrounding walk spaces and work areas, potentially causing safety and environmental hazards. The present invention is designed to prevent drilling fluid from splashing onto walkways and working surfaces around the shale shaker.

SUMMARY OF THE INVENTION

The present invention is a splash guard designed to prevent drilling fluid from splashing onto walkways and working surfaces around a shale shaker. The splash guard is equipped with frame assemblies and vertical panels that are supported by vertical legs rising from base plates attached to the shale shaker. The vertical panels are positioned so that any fluid splashing out of the shale shaker strikes the panels and then drains back into the shale shaker.

BRIEF DESCRIPTION OF THE DRAWING

The accompanying drawings are provided for the purpose of illustration only and are not intended as a definition of the limits of the present invention. The drawings illustrate a preferred embodiment of the present invention, wherein.

DESCRIPTION OF THE INVENTION

Figure 1:
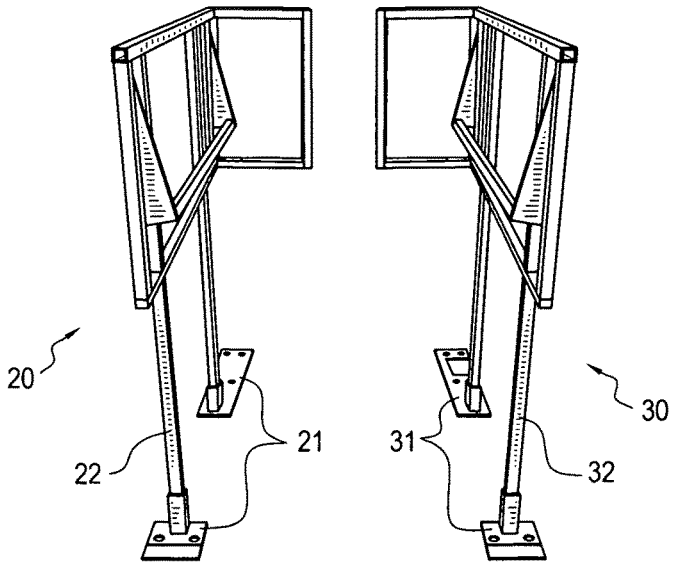
FIG. 1 is a front perspective view of the left and right frame assembly of the present invention.

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

The preferred embodiment of the present invention 10 is designed to fit on a shale shaker 11 similar to the one shown in FIGS. 8 through 17. A shale shaker 11 is typically equipped with a shaker basket 13. The present invention 10 is preferably attached to a shale shaker 11 using base plates 21 and 31, as shown in FIGS. 1 through 11. The particular shale shaker 11 shown in FIGS. 8, 9, 16, and 17 is equipped with side beams 12 upon which base plates 21 and 31 can be placed. Base plates 21 and 31 are preferably made of metal and can be attached to the shale shaker 11 with bolts, or by welding, or by using some other method known to those skilled in the art, as shown in FIGS. 8 through 11 and 16 and 17.

Base plates 21 and 31 are preferably equipped with vertical sockets 29 and 39 for receiving legs 22 and 32, respectively, as shown in FIGS. 1 through 11 and 16 and 17. Sockets 29 and 39 are preferably hollow, metal, and tubular, with inner dimensions slightly larger than the outer dimensions of legs 22 and 32, so that legs 22 and 32 fit snugly into sockets 29 and 39, respectively.

Figure 2:
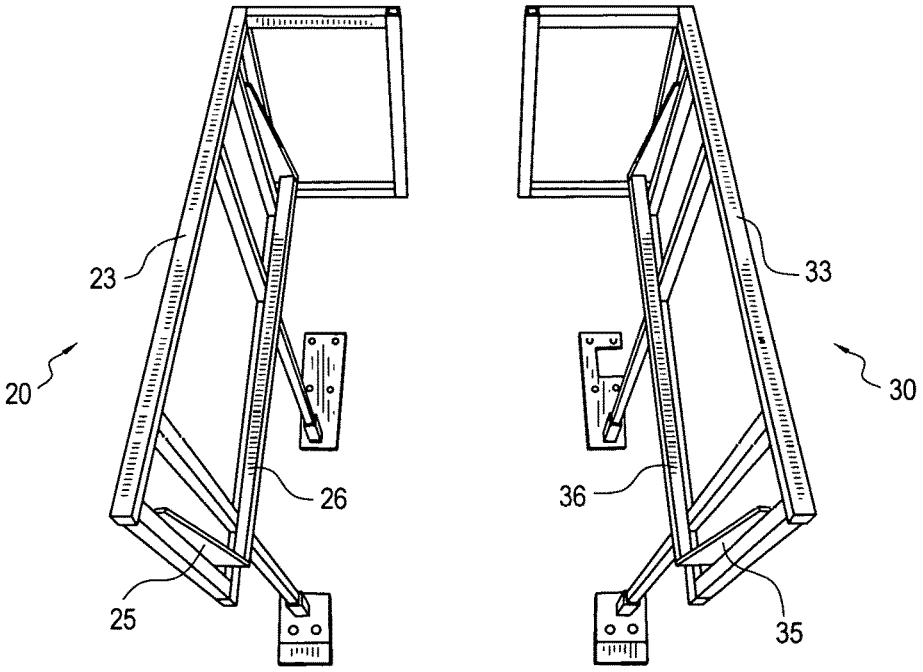
FIG. 2 is a top perspective view of the left and right frame assembly of the present invention.
Figure 3:
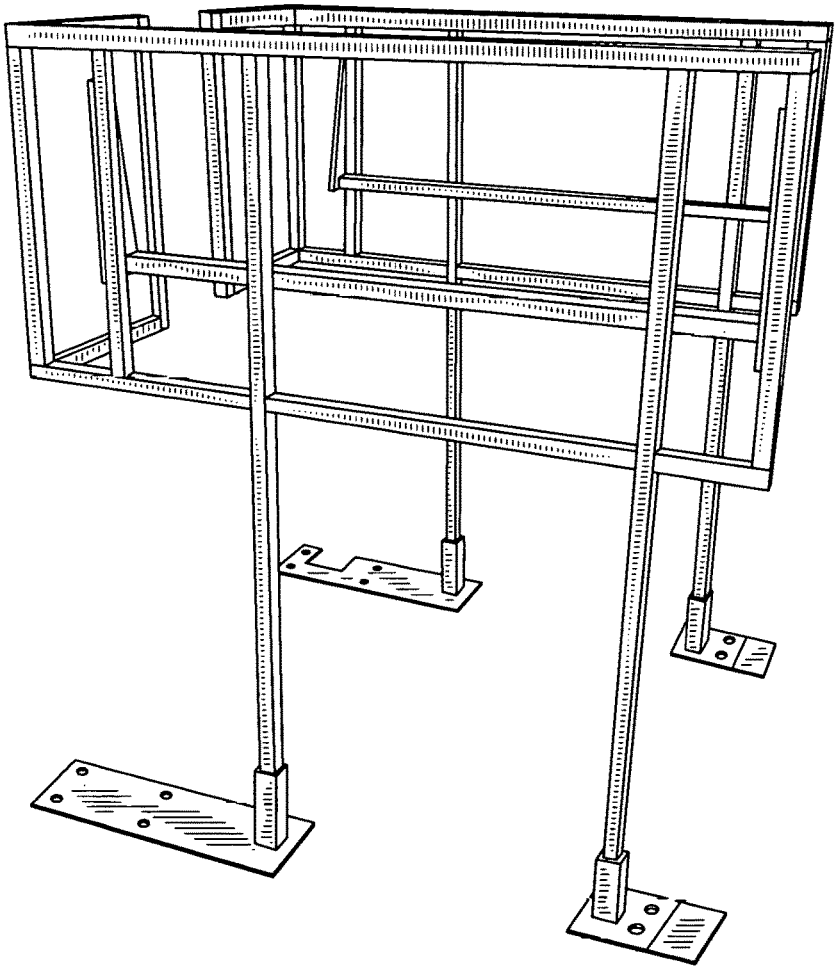
FIG. 3 is a side perspective view of the left and right frame assembly of the present invention.
Figure 4:
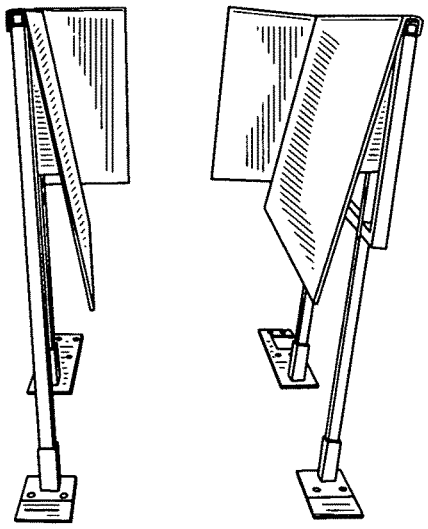
FIG. 4 is a front perspective view of the left and right sides of the present invention.
Figure 5:
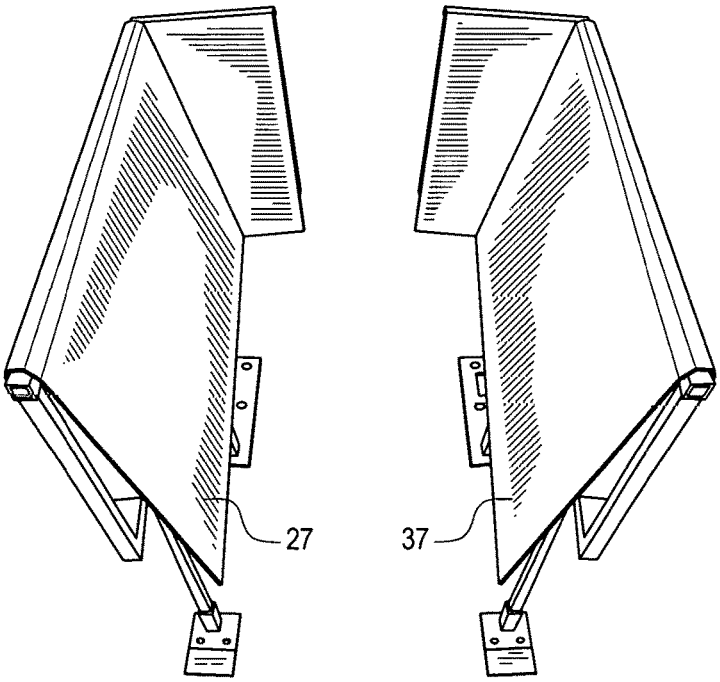
FIG. 5 is a top perspective view of the left and right sides of the present invention.
Figure 6:
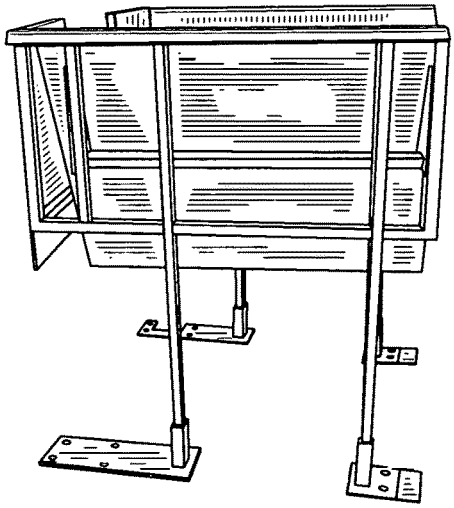
FIG. 6 is a left side perspective view of the present invention.
Figure 7:
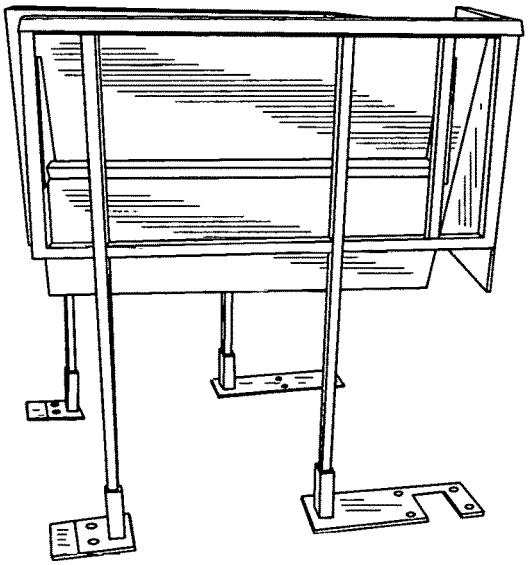
FIG. 7 is a right side perspective view of the present invention.
Figure 8:
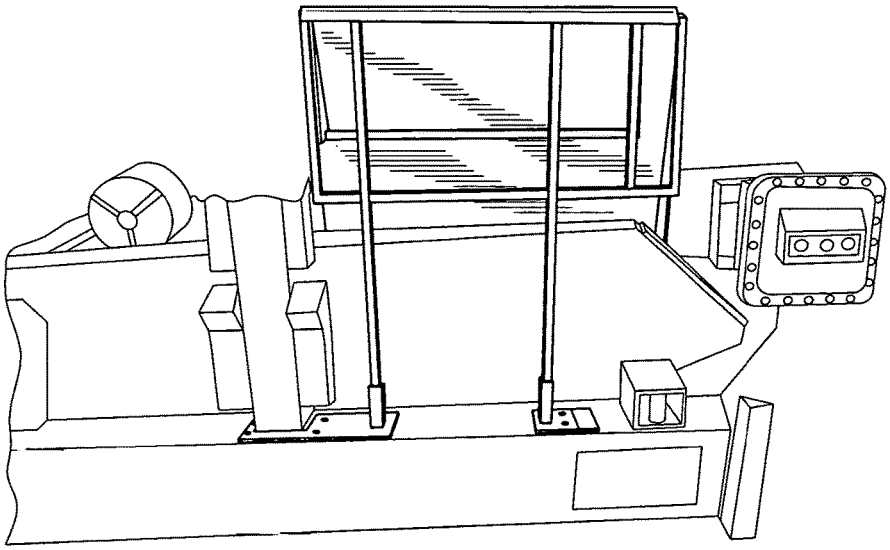
FIG. 8 is a left side view of the present invention installed on a shale shaker.
Figure 9:
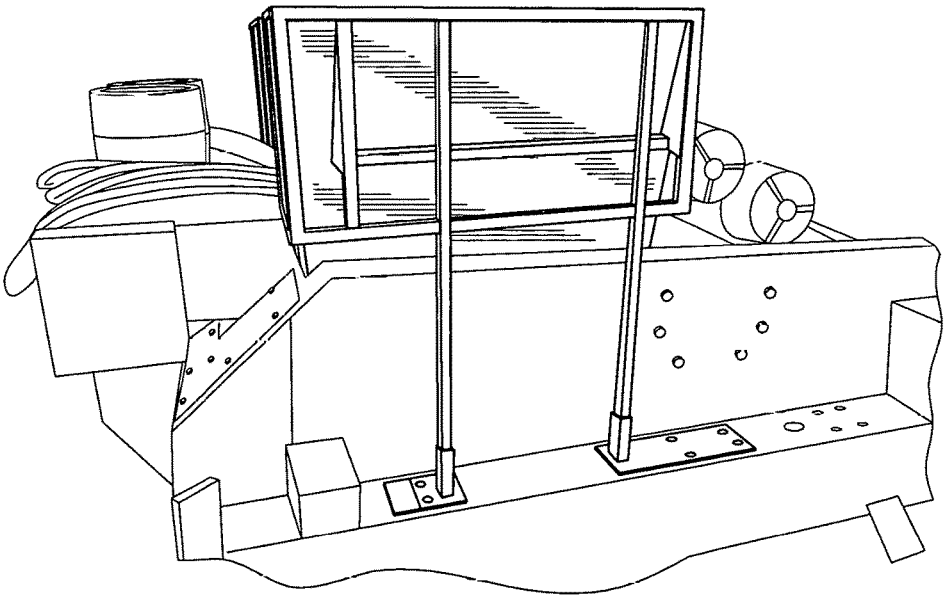
FIG. 9 is a right side view of the present invention installed on a shale shaker.
Figure 10:
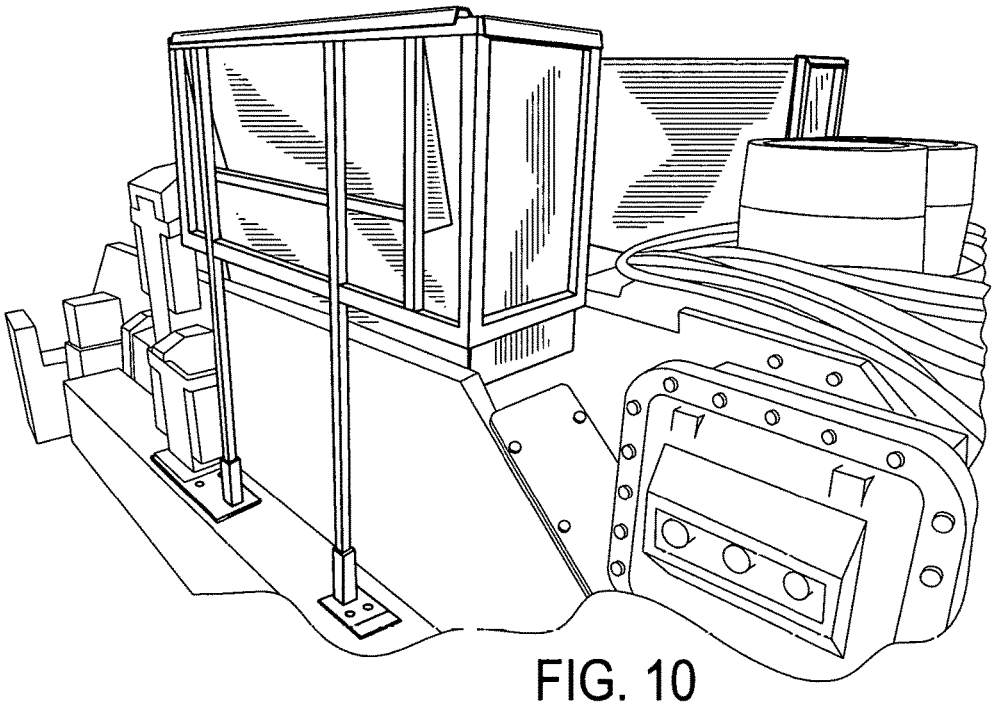
FIG. 10 is a left side perspective view of the present invention installed on a shale shaker.
Figure 11:
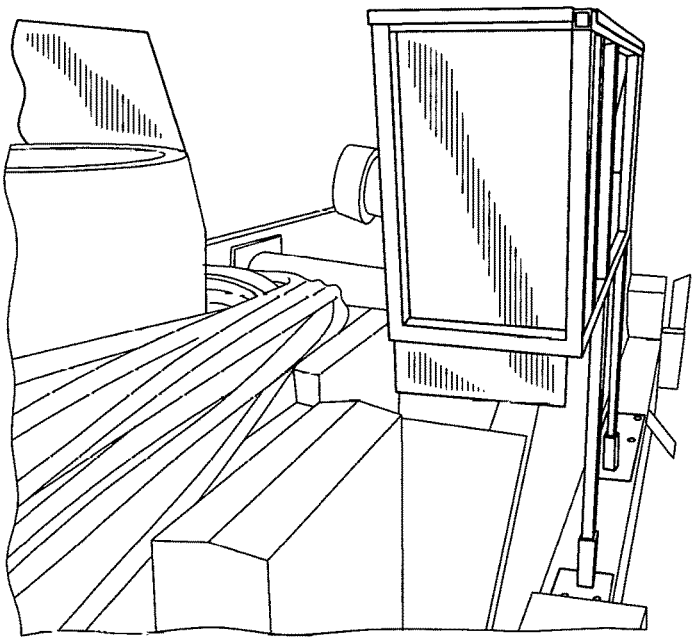
FIG. 11 is a front view of the present invention installed on a shale shaker.
Figure 12:
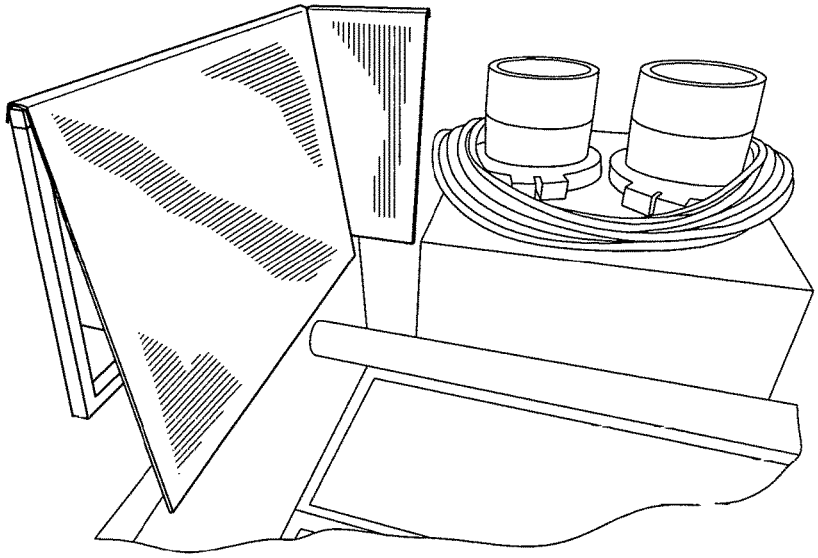
FIG. 12 is a front perspective view of the left side of the present invention installed on a shale shaker.
Figure 13:
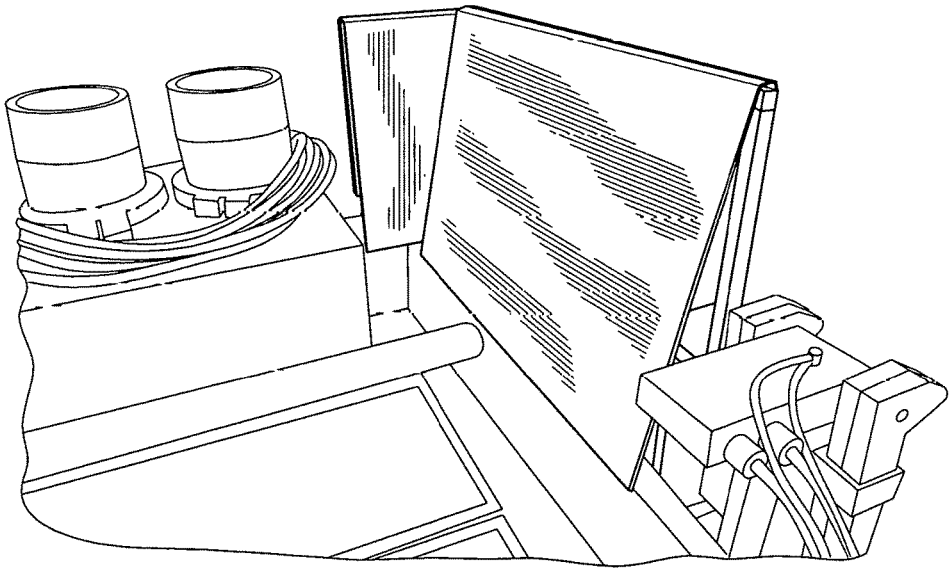
FIG. 13 is a front perspective view of the right side of the present invention installed on a shale shaker.
Figure 14:
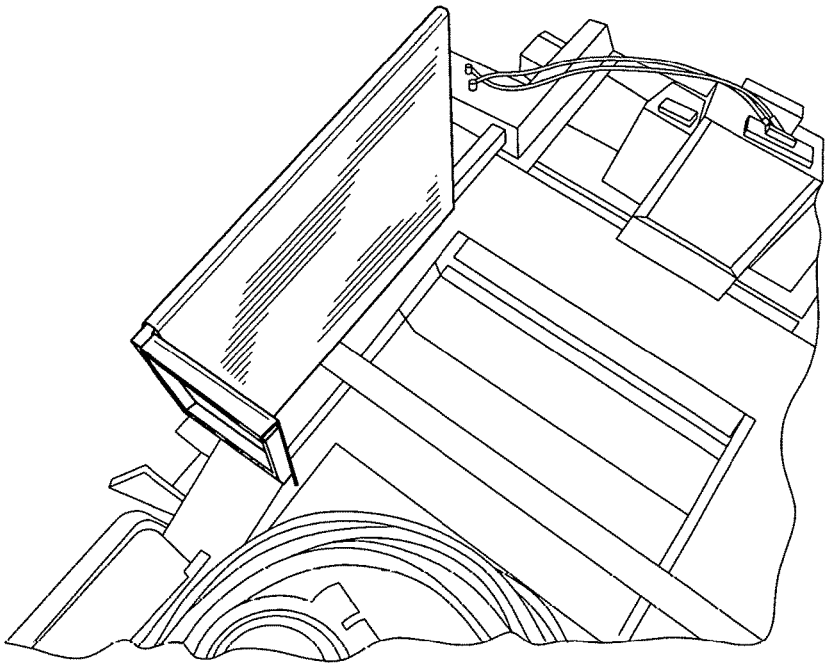
FIG. 14 is a top perspective view of the right side of the present invention installed on a shale shaker.
Figure 15:
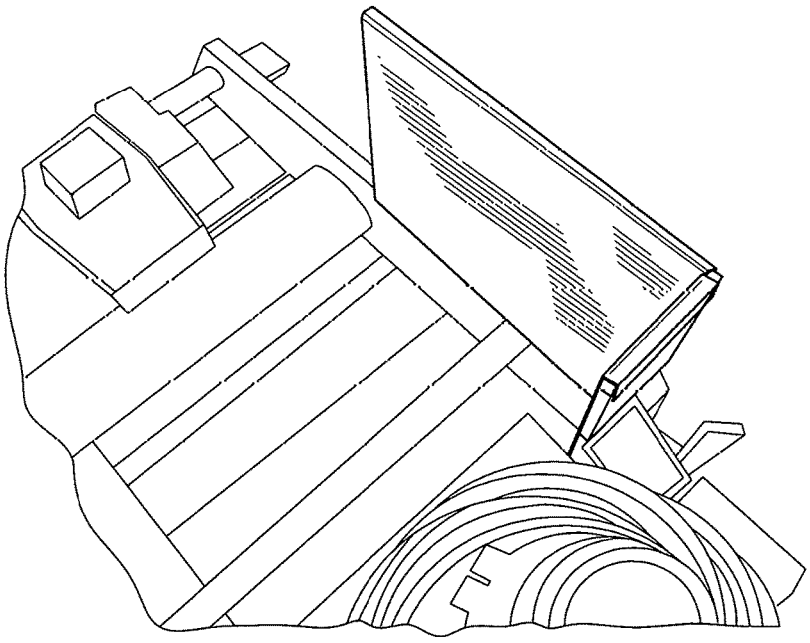
FIG. 15 is a top perspective view of the right side of the present invention installed on a shale shaker.
Figure 16:
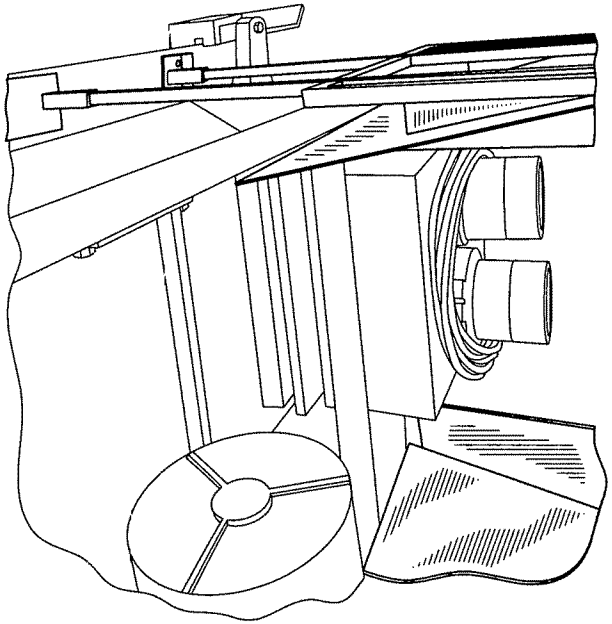
FIG. 16 is a front view of the left side of the present invention installed on a shale shaker.
Figure 17:
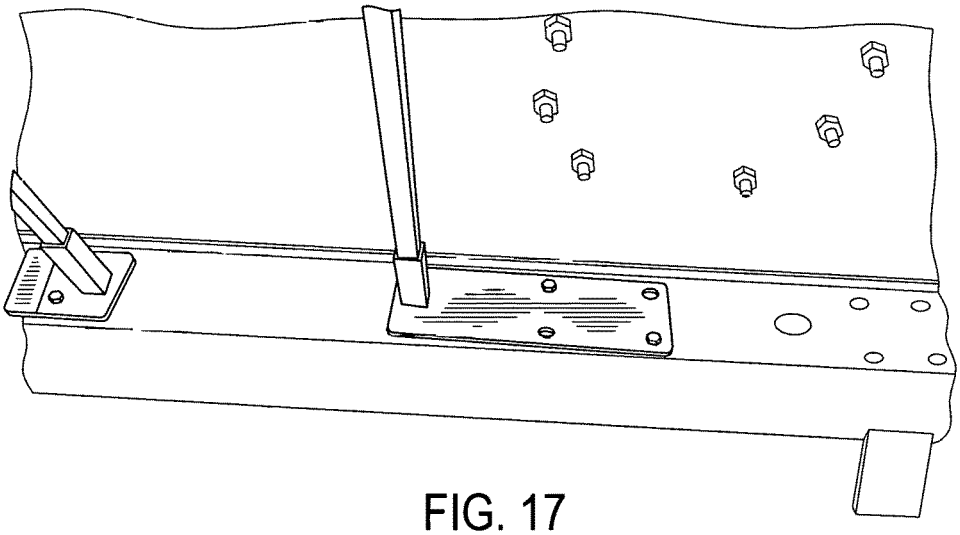
FIG. 17 is a perspective view of the base plates on the left side of the present intention installed on a shale shaker.

Referring now to FIGS. 1, 2, and 3, the present invention preferably includes a left frame assembly 20 and a right frame assembly 30 (discussed below). Left frame assembly 20 has a set of legs 22 that rise vertically from base plates 21. Legs 22 are preferably hollow, metal, and tubular, with outer dimensions slightly smaller than the inner dimensions of sockets 29, so that legs 22 fit snugly and securely into vertical sockets 29.

As shown in FIGS. 1, 2, and 3, left frame assembly 20 can also include a side support frame 23 attached to legs 22. Side support frame 23 is preferably made of hollow, metal, tubular members, and can be attached to legs 22 with bolts, or by welding, or by using some other method known to those skilled in the art. Side support frame 23 provides the framework for supporting angled support arms 25 and side panel 27, as discussed in more detail below.

As shown in FIGS. 1, 2, and 3, back support frame 24 can be attached to side support frame 23 to provide the framework for supporting back panel 28, as discussed in more detail below. Back support frame 24 is preferably made of hollow, metal, tubular members, and can be attached to side support frame 23 with bolts, or by welding, or by using some other method known to those skilled in the art.

As shown in FIGS. 4, 5, 6, and 7, side panel 27 is attached to side support frame 23 to provide a planar surface to prevent fluid from splashing out of the left side of shaker basket 13. Side panel 27 is preferably made of metal and can be attached to side support frame 23 with bolts, or by welding, or by using some other method known to those skilled in the art. Legs 22 preferably rise vertically from sockets 29 to a height where the fluid splashing out of the left side of shaker basket 13 strikes side panel 27 and then drains back into said the shale shaker 11.

In the preferred embodiment, angled support arms 25 are placed between side support frame 23 and side panel 27 to create additional space between side support frame 23 and the lower edge 40 of side panel 27 to ensure that any fluid splashing out of shaker basket 13 onto inner surface of side panel 27 drains back into shale shaker 11. Angled support arms 25 are preferably made of metal and can be attached between side support frame 23 and side panel 27 with bolts, or by welding, or by using some other method known to those skilled in the art.

As shown in FIG. 2, a horizontal bar 26 can be extended between angled support arms 25 to provide additional stability for angled support arms 25 and to provide additional support for side panel 27. Horizontal bar 26 is preferably made of metal and can be attached to angled support arms 25 with bolts, or by welding, or by using some other method known to those skilled in the art.

As shown in FIGS. 4, 5, and 10 through 15, back panel 28 can be attached to back support frame 24 to provide a planar surface to prevent fluid from splashing out of the back left side of shaker basket 13. Back panel 28 is preferably positioned at a height where the fluid splashing out of the back left side of shaker basket 13 strikes back panel 28 and then drains back into said shale shaker 11. Back panel 28 is preferably made of metal and can be attached to back support frame 24 with bolts, or by welding, or by using some other method known to those skilled in the art.

Referring back to FIGS. 1, 2, and 3, right frame assembly 30 has a set of legs 32 that rise vertically from base plates 31. Legs 32 are preferably hollow, metal, and tubular, with outer dimensions slightly smaller than the inner dimensions of sockets 39, so that legs 32 fit snugly and securely into vertical sockets 39.

As shown in FIGS. 1, 2, and 3, right frame assembly 30 also can include a side support frame 33 attached to legs 32. Side support frame 33 is preferably made of hollow, metal, tubular members, and can be attached to legs 32 with bolts, or by welding, or by using some other method known to those skilled in the art. Side support frame 33 provides the framework for supporting angled support arms 35 and side panel 37, as discussed in more detail below.

As shown in FIGS. 1, 2, and 3, back support frame 34 can be attached to side support frame 33 to provide the framework for supporting back panel 38, as discussed in more detail below. Back support frame 34 is preferably made of hollow, metal, tubular members, and can be attached to side support frame 33 with bolts, or by welding, or by using some other method known to those skilled in the art.

As shown in FIGS. 4, 5, 6, and 7, side panel 37 is attached to side support frame 33 to provide a planar surface to prevent fluid from splashing out of the right side of shaker basket 13. Side panel 37 is preferably made of metal and can be attached to side support frame 33 with bolts, or by welding, or by using some other method known to those skilled in the art. Legs 32 preferably rise vertically from sockets 39 to a height where the fluid splashing out of the right side of shaker basket 13 strikes side panel 37 and then drains back into shale shaker 11.

In the preferred embodiment, angled support arms 35 are placed between side support frame 33 and side panel 37 to create additional space between side support frame 33 and the lower edge 41 of side panel 37 to ensure that any fluid splashing out of shaker basket 13 onto inner surface of side panel 37 drains back into shale shaker 11. Angled support arms 35 are preferably made of metal and can be attached between side support frame 33 and side panel 37 with bolts, or by welding, or by using some other method known to those skilled in the art.

As shown in FIG. 2, a horizontal bar 36 can be extended between angled support arms 35 to provide additional stability for angled support arms 35 and to provide additional support for side panel 37. Horizontal bar 36 is preferably made of metal and can be attached to angled support arms 35 with bolts, or by welding, or by using some other method known to those skilled in the art.

As shown in FIGS. 4, 5, and 10 through 15, back panel 38 can be attached to back support frame 34 to provide a planar surface to prevent fluid from splashing out of the back right side of shaker basket 13. Back panel 38 is preferably positioned at a height where the fluid splashing out of the back right side of shaker basket 13 strikes back panel 38 and then drains back into shale shaker 11. Back panel 38 is preferably made of metal and can be attached to back support frame 34 with bolts, or by welding, or by using some other method known to those skilled in the art.

It is understood that one embodiment of the present invention has been disclosed by way of example and that other modifications and alterations may occur to those skilled in the art without departing from the scope and spirit of the appended claims.

What is claimed is:

1. A splash guard for preventing fluids from splashing out of a shaker basket in a shale shaker, said splash guard comprising:

(a) a plurality of base plates for securing said splash guard to said shale shaker;

(b) a vertical leg extending upwardly from each of said base plates, wherein each of said vertical legs are constructed with hollow, metal, tubular members;

(c) a plurality of frame assemblies attached to said vertical legs, wherein said plurality of said frame assemblies are constructed with hollow, metal, tubular members;

(d) a metal panel attached substantially vertically to each of said frame assemblies, each of said panels having a lower edge and an inner surface, where said lower edge of each of said panels is positioned so that any fluid splashing out of said shaker basket onto said inner surface of each of said panels drains back into said shale shaker;

(e) at least one angle arm positioned between each of said frame assemblies and said corresponding panels to create space between each of said frame assemblies and said lower edge of said corresponding panels to ensure that any fluid splashing out of said shaker basket onto said inner surface of said panels drains back into said shale shaker; and (f) a vertical socket attached to each of said base plates for receiving and supporting a vertical leg.

2. A splash guard for preventing fluids from splashing out of a shaker basket in a shale shaker, said splash guard comprising:

(a) a plurality of left base plates for securing said splash guard to said shale shaker, (b) a plurality of right base plates for securing said splash guard to said shale shaker;

(c) a left vertical leg extending upwardly from each of said left base plates, wherein said left vertical legs are constructed with hollow, metal, tubular members;

(d) a right vertical leg extending upwardly from each of said right base plates, wherein said right vertical legs are constructed with hollow, metal, tubular members;

(e) a left side frame assembly attached to said left vertical legs, said left side frame assembly having a back end, and wherein said left side frame assembly is constructed with hollow, metal, tubular members;

(f) a right side frame assembly attached to said right vertical legs, said right side frame assembly having a back end, and wherein said right side frame assembly is constructed with hollow, metal, tubular members;

(g) a metal left side panel attached substantially vertically to said left side frame assembly, said metal left side panel having a lower edge and an inner surface, where said lower edge of said metal left side panel is positioned so that any fluid splashing out of said shaker basket onto said inner surface of said metal left side panel drains back into said shale shaker;

(h) a metal right side panel attached substantially vertically to said right side frame assembly, said metal right side panel having a lower edge and an inner surface, where said lower edge of said metal right side panel is positioned so that any fluid splashing out of said shaker basket onto said inner surface of said metal right side panel drains back into said shale shaker;

(i) a plurality of left angle arms positioned between said left side frame assembly and said left side panel to create space between said left side frame assembly and said lower edge of said left side panel, and to ensure that any fluid splashing out of said shaker basket onto said inner surface of said left side panel drains back into said shale shaker;

(j) a plurality of right angle arms positioned between said right side frame assembly and said right side panel to create space between said right side frame assembly and said lower edge of said right side panel, and to ensure that any fluid splashing out of said shaker basket onto said inner surface of said right side panel drains back into said shale shaker;

(k) a vertical socket attached to each of said left base plates for receiving and supporting said left vertical legs;

(l) a vertical socket attached to each of said right base plates for receiving and supporting said right vertical legs;

(m) a left back frame assembly extending from said back end of said left side frame assembly toward said right side frame assembly, wherein said left back frame assembly is constructed with hollow, metal, tubular members;

(n) a metal left back panel attached substantially vertically to said left back frame assembly, said metal left back panel having a lower edge and an inner surface, where said lower edge of said metal left back panel is positioned so that any fluid splashing out of said shaker basket onto said inner surface of said metal left back panel drains back into said shale shaker;

(o) a right back frame assembly extending from said back end of said right side frame assembly toward said left side frame assembly, wherein said right back frame assembly is constructed with hollow, metal, tubular members; and (p) a metal right back panel attached substantially vertically to said right back frame assembly along said back side of said shaker basket, said metal right back panel having a lower edge and an inner surface, where said lower edge of said metal right back panel is positioned so that any fluid splashing out of said shaker basket onto said inner surface of said metal right back panel drains back into said shale shaker.

3. A splash guard for preventing fluids from splashing out of a shale shaker, said splash guard comprising:

(a) a shale shaker having a left side, a right side, and a shaker basket, said shaker basket having a length and a back side;

(b) at least one left base plate for securing said splash guard to said left side of said shale shaker;

(c) at least one right base plate for securing said splash guard to said right side of said shale shaker;

(d) a left vertical leg extending upwardly from each of said at least one left base plate, wherein said left vertical legs are constructed with hollow, metal, tubular members;

(e) a right vertical leg extending upwardly from each of said at least one right base plate, wherein said right vertical legs are constructed with hollow, metal, tubular members;

(f) a left side frame assembly attached to said left vertical leg or legs, wherein said left side frame assembly is constructed with hollow, metal, tubular members;

(g) a right side frame assembly attached to said right vertical leg or legs, wherein said right side frame assembly is constructed with hollow, metal, tubular members;

(h) a metal left side panel attached substantially vertically to said left side frame assembly, where said metal left side panel extends along said length of said shaker basket, said metal left side panel having a lower edge and an inner surface, where said lower edge of said metal left side panel is positioned so that any fluid splashing out of said shaker basket onto said inner surface of said metal left side panel drains back into said shale shaker;

(i) a metal right side panel attached substantially vertically to said right side frame assembly, where said metal right side panel extends along said length of said shaker basket, said metal right side panel having a lower edge and an inner surface, where said lower edge of said metal right side panel is positioned so that any fluid splashing out of said shaker basket onto said inner surface of said metal right side panel drains back into said shale shaker;

(j) at least one left angle arm positioned between said left side frame assembly and said left side panel to create space between said left side frame assembly and said lower edge of said left side panel, and to ensure that any fluid splashing out of said shaker basket onto said inner surface of said left side panel drains back into said shale shaker;

(k) at least one right angle arm positioned between said right side frame assembly and said right side panel to create space between said right side frame assembly and said lower edge of said right side panel, and to ensure that any fluid splashing out of said shaker basket onto said inner surface of said right side panel drains back into said shale shaker;

(l) a vertical socket attached to each of said left base plates for receiving and supporting said left vertical legs;

(m) a vertical socket attached to each of said right base plates for receiving and supporting said right vertical legs;

(n) a left back frame assembly extending from said left side frame assembly, where said left back frame assembly extends along a portion of said back side of said shaker basket, and wherein said left back frame assembly is constructed with hollow, metal, tubular members;

(o) a metal left back panel attached substantially vertically to said left back frame assembly along said back side of said shaker basket, said metal left back panel having a lower edge and an inner surface, where said lower edge of said metal left back panel is positioned so that any fluid splashing out of said shaker basket onto said inner surface of said metal left back panel drains back into said shale shaker;

(p) a right back frame assembly extending from said right side frame assembly, where said right back frame assembly extends along a portion of said back side of said shaker basket, and wherein said right back frame assembly is constructed with hollow, metal, tubular members; and (q) a metal right back panel attached substantially vertically to said right back frame assembly along said back side of said shaker basket, said metal right back panel having a lower edge and an inner surface, where said lower edge of said metal right back panel is positioned so that any fluid splashing out of said shaker basket onto said inner surface of said metal right back panel drains back into said shale shaker.

* * * * *